US007674118B2

(12) United States Patent
He

(10) Patent No.: US 7,674,118 B2
(45) Date of Patent: Mar. 9, 2010

(54) ELECTRICAL CONNECTOR

(75) Inventor: Hua He, Shanghai (CN)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/257,964

(22) Filed: Oct. 24, 2008

(65) Prior Publication Data

US 2009/0130873 A1 May 21, 2009

(30) Foreign Application Priority Data

Oct. 25, 2007 (CN) ..... 2007 2 0194819 U

(51) Int. Cl.
*H01R 13/648* (2006.01)

(52) U.S. Cl. ..... 439/108; 439/79; 439/607.5

(58) Field of Classification Search ..... 439/79, 439/108, 607.5
See application file for complete search history.

(56) References Cited

U.S. PATENT DOCUMENTS

| | | | | |
|---|---|---|---|---|
| 6,350,134 | B1 * | 2/2002 | Fogg et al. | 439/79 |
| 6,540,559 | B1 * | 4/2003 | Kemmick et al. | 439/607.05 |
| 6,863,549 | B2 * | 3/2005 | Brunker et al. | 439/108 |
| 6,935,870 | B2 | 8/2005 | Kato et al. | |
| 7,077,668 | B2 | 7/2006 | Lapidot et al. | |
| 7,090,540 | B2 | 8/2006 | Masumoto et al. | |
| 7,214,074 | B2 * | 5/2007 | Osada | 439/79 |
| 7,247,058 | B2 * | 7/2007 | Reeser et al. | 439/701 |
| 7,303,410 | B2 * | 12/2007 | Saito | 439/108 |
| 7,435,107 | B2 | 10/2008 | Masumoto et al. | |
| 7,462,059 | B2 * | 12/2008 | Saito et al. | 439/397 |
| 2004/0092143 | A1 | 5/2004 | Fromm et al. | |
| 2005/0059296 | A1 | 3/2005 | Wang | |
| 2007/0099512 | A1 | 5/2007 | Sato | |

FOREIGN PATENT DOCUMENTS

| | | |
|---|---|---|
| CN | 2796166 | 7/2006 |
| WO | WO 2006/010098 A1 | 1/2006 |

OTHER PUBLICATIONS

International Search Report for PCT/US2008/081134.

* cited by examiner

*Primary Examiner*—Truc T Nguyen
(74) *Attorney, Agent, or Firm*—Stephen L. Sheldon

(57) ABSTRACT

An electrical connector includes an insulating body and a plurality of signal terminals and ground terminals contained therein. Each terminal includes a contact portion, a foot portion and a connection portion therebetween. The contact portions are arranged in two lines on the insulating body, and the foot portions are arranged in two lines. The locations of the free ends of the foot portions included in one line correspond with the location arrangement of their contact portions. Compared with the free ends of the foot portions of each signal terminal pair in the line, the distance between the free ends of the foot portions of two corresponding adjacent terminals in the other line is increased.

27 Claims, 10 Drawing Sheets

ELECTRICAL CONNECTOR

BACKGROUND OF THE INVENTION

This application claims priority to PRC (China) Application No 200720194819.1, filed Oct. 25, 2007.

The present invention relates generally to an electrical connector, and more particularly to an electrical connector for transmitting high speed differential signals.

The conventional electrical connector for transmitting high speed differential signals has broad applications in the communications field, and some of these applications are disclosed by U.S. Pat. Nos. 7,090,540 and 7,077,668. FIGS. 1 and 2, which are drawings from U.S. Pat. No. 7,077,668, provide an electrical connector 6 comprising an insulating body 60, a plurality of terminals 61 contained in the insulating body 60, and a cover 62 shielding the insulating body 60. The insulating body 60 has a connection portion 600 and a plurality of terminal containing slots respectively containing the terminals 61 and passing through the connection portion 600. The terminals 61 comprise signal terminals, ground terminals and other terminals with different uses. The terminals labeled as a, c, d, f, g, i, j and l are signal terminals, and two of these terminals are used as a pair to transmit differential signals. The terminals labeled as b, e, h and k are ground terminals, and the remaining terminals m-s may have different uses. Each of the terminals 61 comprises a contact portion 610 for a connection use, a foot portion 611 connected to a circuit board 7, such as for example by soldering, and a connection portion (not shown) connecting the contact portion 610 with the foot portion 611. The contact portions 610 of the terminals 61 located in the connection portion 600 comply with the standard of High Definition Multimedia Interface ("HDMI"), and are arranged in two rows as viewed from the front of the connector in FIG. 1. By contrast, the foot portions 611 of the terminals 61, as shown in FIG. 2, are arranged in three lines, or rows, that are respectively identified by corresponding pad groups 70, 71 and 72 on the circuit board 7, each of which is aligned with a foot portion line. The pads 70 comprise the pad group that is most adjacent to the center of the connection portion 600, and can connect a corresponding set of terminals to the ground. The other two pad groups 71 and 72 are aligned with two terminals of each differential signal terminal pair. One of the leads 73 connected to the middle pad group 71 goes through two adjacent pads 72 of the different group. Therefore, the distance between the two terminals of each differential signal terminal pair is not sufficient to reduce interference from occurring between the pair of differential signals applied to the differential signal terminal pair.

Such a conventional electrical connector 6 provides an equal distance between the foot portions 611 of the two terminals 61 of each differential signal terminal pair, but the three lines of pads 70, 71 and 72 occupy more area on the circuit board 7. Consequentially, such conventional technology is not suitable to be adapted to current electrical products that follow the current miniaturization trend.

The present invention provides an electrical connector which overcomes the problems presented in the prior art and which provides additional advantages over the prior art, such advantages will become clear upon a reading of the attached specification in combination with a study of the drawings.

SUMMARY OF THE INVENTION

An electrical connector has a terminal arrangement which allows the distance between adjacent sets of differential signal pairs to be increased at the mounting end of the connector.

The interference between the adjacent sets of differential signal pairs can be reduced, and the size of the entire electrical connector need not be increased despite such improvements.

The electrical connector provides an electrical connector comprising an insulating body, a plurality of signal terminals and a plurality of grounds terminals, both contained in the insulating body. Each of the signal terminals and ground terminals comprises a contact portion, a foot portion and a connection portion connecting the contact portion to the foot portion. The contact portions of the terminals are arranged in two lines on the insulating body, with the foot portions are also arranged in two lines. The location arrangement of the free ends of the foot portions of the signal terminals and ground terminals included in one line correspond with the location arrangement of their contact portions. Compared with the free ends of the foot portions of each signal terminal pair in the line, the distance between the free ends of the foot portions of two corresponding adjacent terminals in the other line is increased.

The arrangement of the contact portions of the signal terminals and ground terminals complies with the standard of High Definition Multimedia Interface but is not limited in application. For two pairs of adjacent foot portions, the pitch between the foot portions is increased. The increased distance between these foot portions is two times the distance between other pairs of adjacent foot portions located in the same line. The connection portion of each terminal extends first horizontally from the contact portion, and then extends vertically. The insulation body can include a retaining plate through which a plurality of retaining holes are provided. The foot portions of the terminals are inserted into the corresponding retaining holes and retained therein. The insulation body further includes engagement grooves, and engagement bumps are provided on two edges of the retaining plate for engaging with the engagement grooves.

Compared with the conventional electrical connector having foot portions arranged in three lines, the present electrical connector features both contact portions and foot portions arranged in two lines. The arranged sequence of the terminals is identical to each other for the two lines. The pitches of the foot portions of one line are varied within a certain segment. Therefore, the interference between the terminal can be reduced, and the structure is simplified so that the electrical connector is suitable for miniaturized electrical products.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENT

Figure 1:
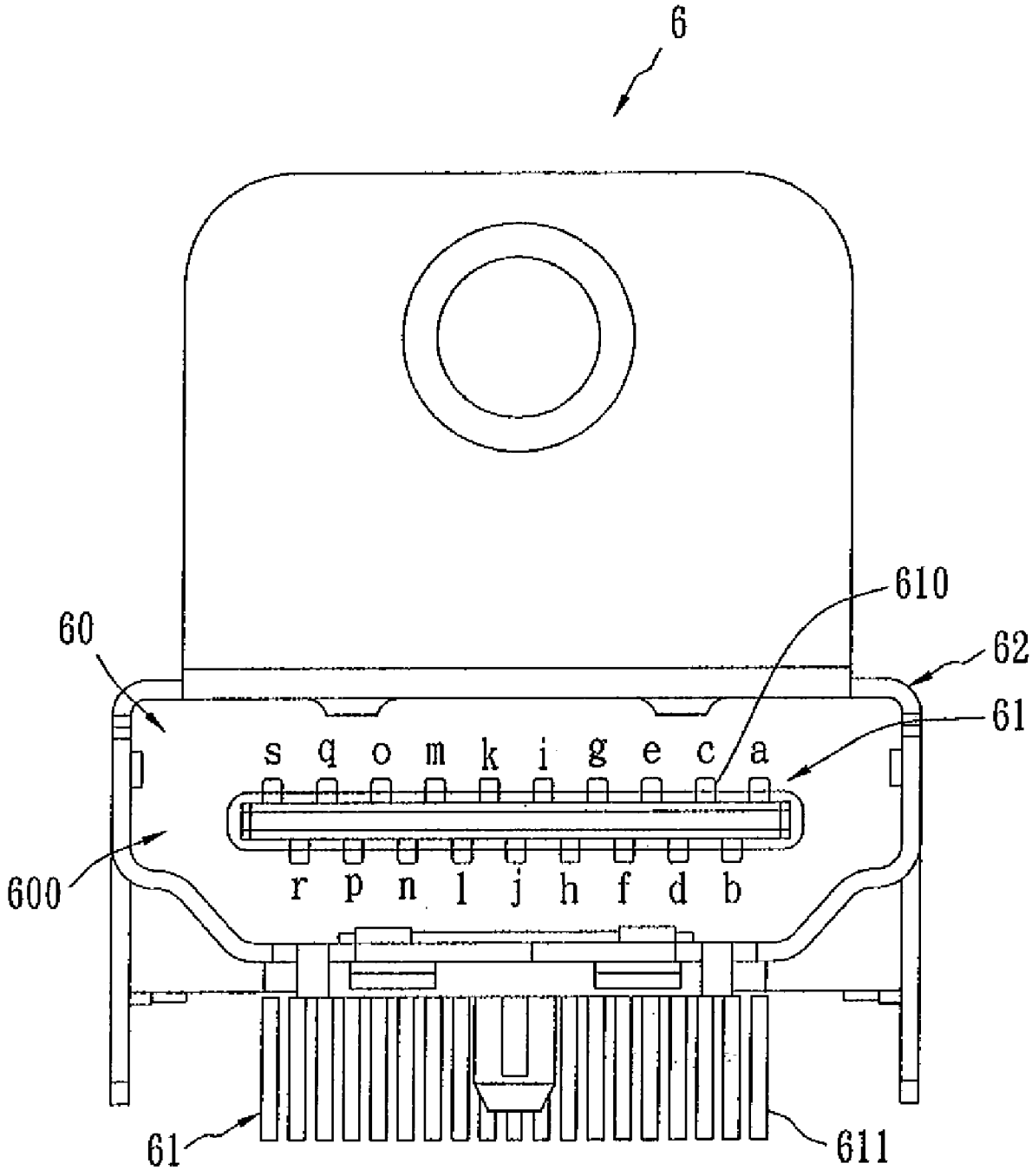
FIG. 1 (Prior Art)
FIG. 1 is a front view of a prior art electrical connector.

While the invention may be susceptible to embodiment in different forms, there is shown in the drawings, and herein will be described in detail, a preferred embodiment with the understanding that the present disclosure is to be considered an exemplification of the principles of the invention, and is not intended to limit the invention to that as illustrated and described herein.

Figure 3:
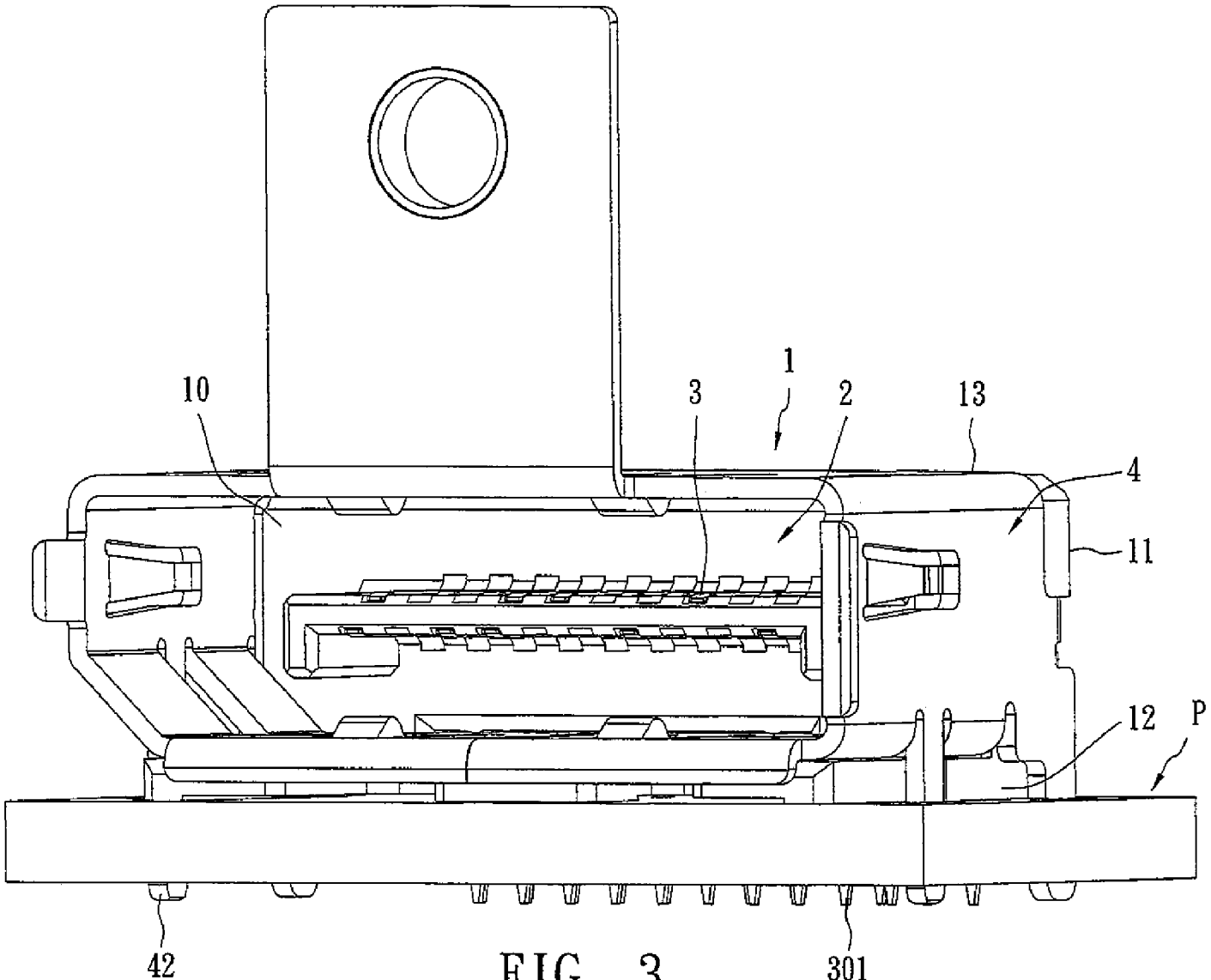
FIG. 3 is a axonometric view of an embodiment of a electrical connector coupled to a circuit board.

FIG. 3 illustrates an electrical connector 1 for transmitting differential signals at high speeds. The connector 1 includes an insulative housing, or body 2, a plurality of terminals 3 contained in the insulating body 2 and a cover 4 shielding the insulative body 2. The connector 1 is mounted on a circuit board P, and allows a counterpart mating connector (not shown) to connect with the connector 1 so that the high-speed differential signals can be transmitted therein. The side of the connector 1 facing the mating connector is hereinafter called a connection or mating side 10, the side opposite the connection side 10 is hereinafter called a rear or mounting side 11, the side of the connector 1 facing the circuit board is hereinafter called a bottom side 12, and the side opposite the bottom side 12 is hereinafter called an upper side 13.

Figure 4:
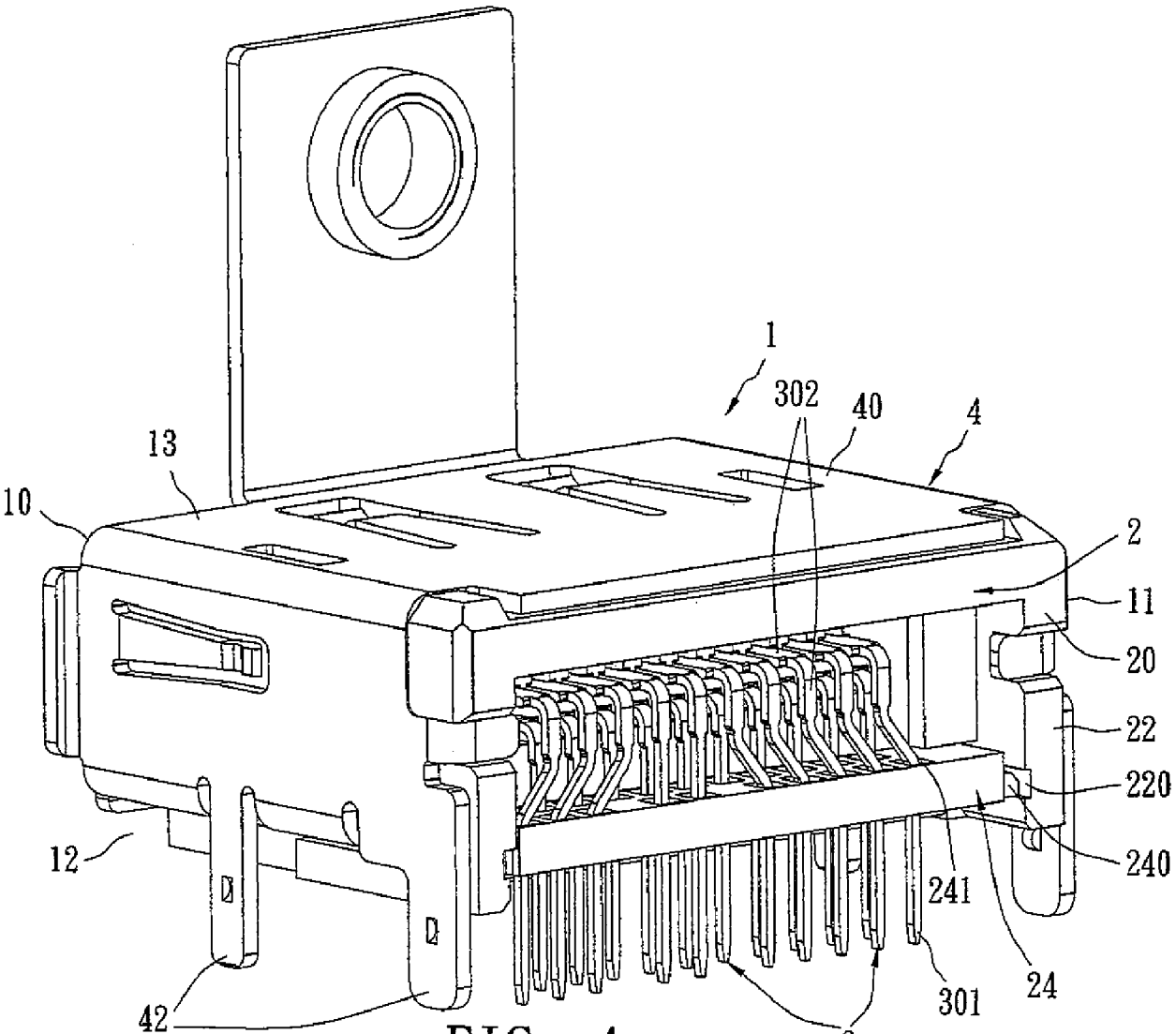
FIG. 4 is an alternate axonometric view of the connector depicted in FIG. 3.
Figure 5:
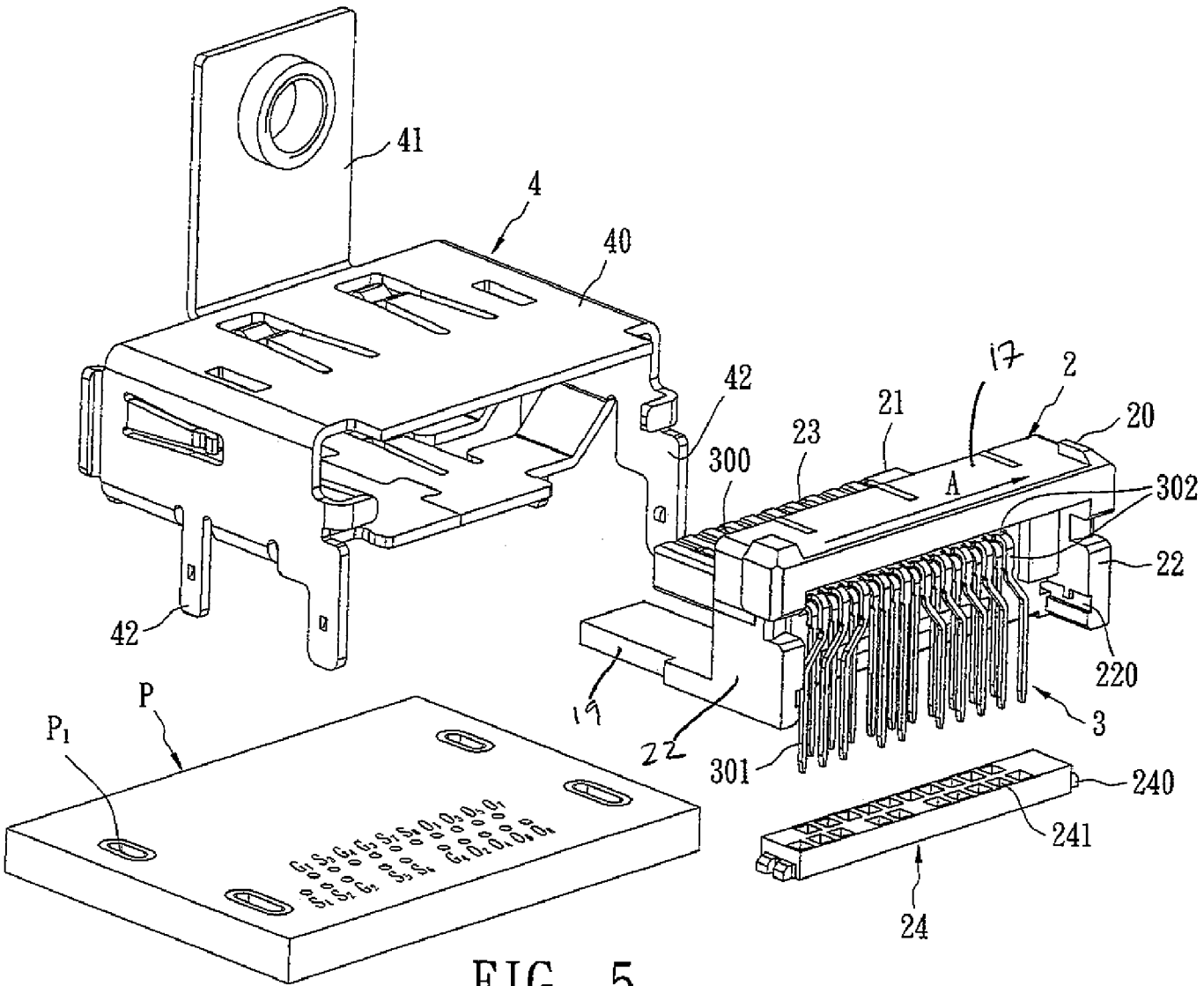
FIG. 5 is an exploded axonometric view of the connector of FIG. 3, including a circuit board to which the connector is mounted as shown in FIG. 3.

As shown in FIGS. 4 and 5, the insulative body 2 comprises a main body 20 and a terminal housing portion 21 attached to the main body 20. The main body 20 has a bridge portion 17 and a frame 22 extending downwardly from the bridge portion 17 at the opposite ends thereof. A forward portion 19 of the frame 22 extends toward the connection side 10. The terminal housing portion 21 extends between the frames 22 from the connection side 10 to the rear side 11. A plurality of terminal-containing slots 23 are provided through the terminal housing portion 21 from the mating side 10 to the mounting side 11. The location of each terminal-containing slot 23 is determined by which terminal 3 is inserted into the terminal-containing slot 23.

The terminals 3 of the connector are primarily arranged in pairs of differential signal terminals, and each such differential signal terminal pair has a ground terminal associated with it. As shown best in FIGS. 5-8, the connector 1 has twenty terminals 3, including four pairs of differential signal terminals (sequentially labeled as S1-S8 along the direction A in the Figures), four ground terminals (sequentially labeled as G1-G4) and eight terminals that may be used for functions other than transmitting differential and ground signals (sequentially labeled as O1-O8). For example, the terminals may be used to transmit power or return power or hot plug detection and may also be used as one or more auxiliary signal channels.

Figure 6:
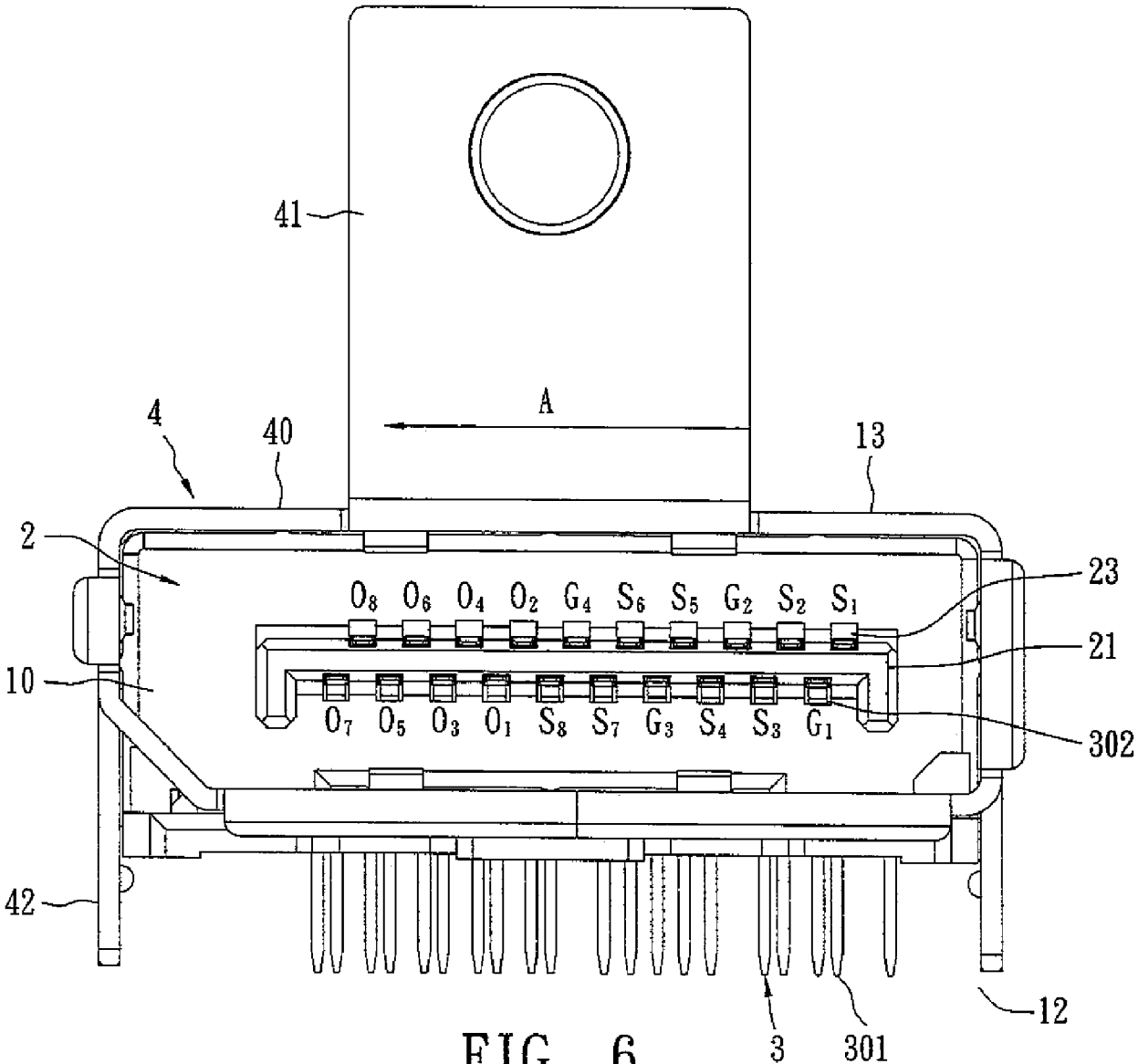
FIG. 6 is a front view of the connector depicted in FIG. 3.

Each terminal 3 includes a contact portion 300 for connecting to a mating connector, a foot, or tail portion, 301 connected to a circuit board P and a connection portion 302 interconnecting the contact portion 300 with the foot portion 301. The contact portions 300 of the terminals 3 which are located in the terminal housing portion 21 of the insulation body 2 may comply with the HDMI standard (or any other desirable standard), and each of the signal terminals associated with a ground terminal are arranged in two rows in a staggered manner as shown in FIG. 6.

In practice, the first pair of signal terminals S1, S2 cooperates with the first ground terminal G1 to form a first terminal set and to define a differential signal transmission line through the connector, the second pair of signal terminals S3, S4 cooperates with the second ground terminal G2 to form a second set, the third pair of signal terminals S5, S6 cooperates with the third ground terminal G3 to form a third set, and the fourth pair of signal terminals S7, S8 cooperates with the fourth ground terminal G4 to form a fourth set. The two differential signal terminals of each of these sets are arranged in the same row, while, the associated ground terminal of the respective set is located in the other row and the three terminals appear at the front of the connector as apexes of approximate isosceles triangle. Adjacent terminal sets are disposed in an inverted, or staggered arrangement. That is, the ground terminal of one set and the signal terminals of the other set are sequentially placed in the same row, and hence one ground terminal is interposed between two adjacent pairs of signal terminals in that row. For example, as shown clearly in FIG. 6, the contact portions 300 of the first signal terminals S1, S2 are placed in the upper row, and the contact portion 300 of the first ground terminal G1 is placed in the lower row; the contact portions 300 of the second signal terminals S3, S4 are placed in the lower row and adjacent to the first ground terminal G1, and the contact portion 300 of the second ground terminal G2 is placed in the upper row and adjacent to contact portion 300 of the first signal terminals S1, S2. The other terminals 3 with different function are sequentially placed in the upper row where the terminals S1, S2, G2, S5 and S6 exist and the lower row where the terminals G1, S3, S4, G3, S7, and S8 are arranged along the A direction.

A horizontal segment of the connection portion 302 of each terminal 3 extends from the contact portion 300 along the terminal containing slot 23, and has an interference fit with the side walls of the terminal-containing slot 23 so as to be retained therein. (FIG. 5.) The connection portion 302 extends outwardly from the terminal containing-slot 23 and is bent from its horizontal segment to form a vertical segment. The foot portion 301 of each terminal 3 extends from the vertical segment of the connection portion 302. The foot portions 301 of the terminals 3 which started in the lower row on the connection side 10 have the same arrangement sequence as their corresponding contact portions 300 (G1, S3, S4, G3, S7, S8), and the distance between any two adjacent foot portions 301 is equal to a constant dimension D in FIG. 8. The foot portions 301 of the terminals 3 which started in the upper row on the connection side 10 have the same arrangement sequence as their corresponding contact portions 300 (S1, S2, G2, S5, S6), but the distances between adjacent foot portions 301 are partially varied. That is, the distance between the two adjacent foot portions 301 of terminals S1/S2, S2/G2, S5/S6 is equal to the pitch, or constant dimension D, and the distance between the two adjacent foot portions 301 of terminals G2/S5, S6/G4 is two times the constant dimension D. Attention is invited to FIG. 8 which further shows the various distances in the layout of pads P2 on the circuit board P. The locations of the pads P2 correspond directly to the free ends of the tail portions 301 of the terminals 3, and are specifically marked by the letters of the corresponding terminals.

Therefore, the distance between the ground terminal G2 of the second set and the adjacent signal terminal S5 of the third set is two times the constant dimension D. Similarly, the distance between the fourth ground terminal G4 of the fourth set and the adjacent signal terminal S6 in the third set is also two times the constant dimension D. To meet these arrangements, the tail portions 301 of the terminals G1, S3, S4, G3, S7 and S8 extend vertically from their corresponding vertical segments of their connection portion s302; the tail portions 301 of the terminals S5 and S6 extend vertically from the vertical segments of their corresponding connection portions 302, but the horizontal segments of terminals S5 and S6 are longer than the horizontal segments of terminals G1, S3, S4, G3, S7 and S8; the tail portions 301 of the terminals G2, S2, S1 are bent and extend laterally and away at an angle toward one of the frame members 22, and then extend vertically; and the tail portions 301 of the terminal G4 (and any terminals proximate thereto) are also bent and extend laterally and away at an angle toward the other frame members 22, and then extend vertically. Referring to the layout of the pads P2 on the circuit board P, the tail portions 301 of other terminals 3 of the connector 1 allow the circuit board P to provide sufficient routing space for the traces connected to the pads P2 in the inner line (close to the connection side 10 of the electrical connector 1 in FIG. 8) so that noise interference can be avoided. An embodiment of a trace routing is shown in FIG. 9*b*.

As can be appreciated, therefore, the alignment of the terminals of the connector may be configured so that each differential signal terminal set forms a triangle-shaped terminal group on the mating side of the connector with the sides of the triangle that extend between the associated ground terminal and two signal terminals being approximately equidistant. On the rear, or mounting side, however, one differential signal terminal pair set (S5, S6, G3) forms a first terminal group 401 that is triangular shaped so the sides of the triangle between the ground and the signals are the same size. Furthermore, as can be appreciated from FIG. 9*b*, the first terminal group 401 forms an imaginary acute triangle on the mounting side. "Acute" triangle, as used herein means a triangle wherein each angle is less than 90 degrees. Three other sets form terminal groups 402, 403 and 404 on the mounting side and these terminal groups are also triangular shaped. At least a plurality of the terminal groups 402, 403, 404 form imaginary triangles where the lengths of the sides between the associated ground and signal pair is not equidistant (e.g., one side is substantially longer than the other). As can be readily appreciated from FIG. 9*b*, for example, on the foot side the terminals may be configured so that the terminal groups 402, 403 and 404 form obtuse triangles. "Obtuse" triangle, as used herein means a triangle wherein one of its three angles is greater than 90 degrees. In addition, the second and third terminal groups 403, 404 are positioned on both sides of the terminal group 401 and configured so that the acute triangular arrangement of the first terminal group 401 is surrounded on both sides by the obtuse triangular arrangements of the second and third terminal groups 403, 404. Thus, a plurality of the terminal groups form triangles on the mounting side with the two signal terminals being substantially equidistant from the ground terminal. On the mounting side, however, a majority of those terminal groups formed triangles where the signal pair and the associate ground are configured so that the distance between the ground terminal tail and each of the two signal terminal tail is substantially different.

The cover 4 is formed of metal and includes a containing portion 40 in which the insulation body 2 is mounted, a support frame 41 which extend from one side of the containing portion 40, and mounting feet 42 which extend from the other side of the containing portion 40. The mounting feet 42 are inserted into mounting holes on the circuit board P so that the cover 4 is fixed on the circuit board P.

Because the total height of the connector 1 is greater than that of a conventional electrical connector, the tail portions 301 of the terminals 3 are accordingly lengthened.

The insulative body 2 may include a detachable terminal tail retaining plate 24. The retaining plate 24 looks like a cuboid, and engagement bumps 240 are provided on two short edges of the retaining plate 24. A plurality of retaining holes 241 pass through the retaining plate 24. The foot portions 301 of the terminals 3 pass through the corresponding retaining holes 241. Engagement grooves 220 are provided on the lower sides of the two frames 22 of its main body 20 to hold the retaining plate 24 in the main body 20.

Compared with the conventional electrical connector having tail portions arranged in three rows at the mounting side thereof, the present invention features both the contact portions 300 and the tail portions 301 arranged in two rows. The arranged sequences of the terminals 3 can be identical to each other for the two lines. The pitches of the tail portions 301 of one line are varied within a certain segment. Therefore, the electrical interference, e.g., cross-talk, between the terminals 3 can be reduced, and the structure is simplified so that the connector is suitable for miniaturized electrical products.

Figure 2:
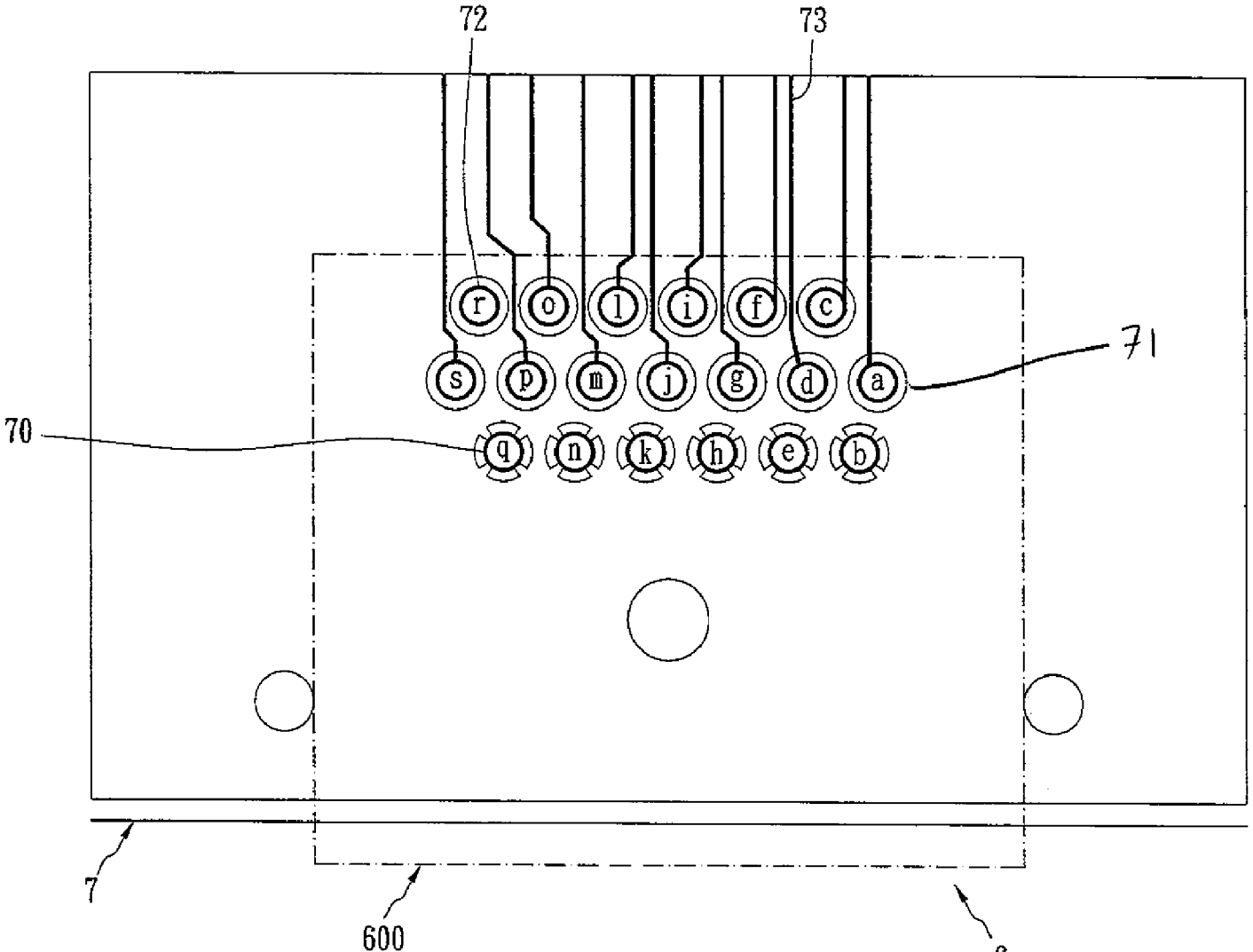
FIG. 2 (Prior Art)
FIG. 2 is a bottom plan view of the connector of FIG. 1.
Figure 9A:
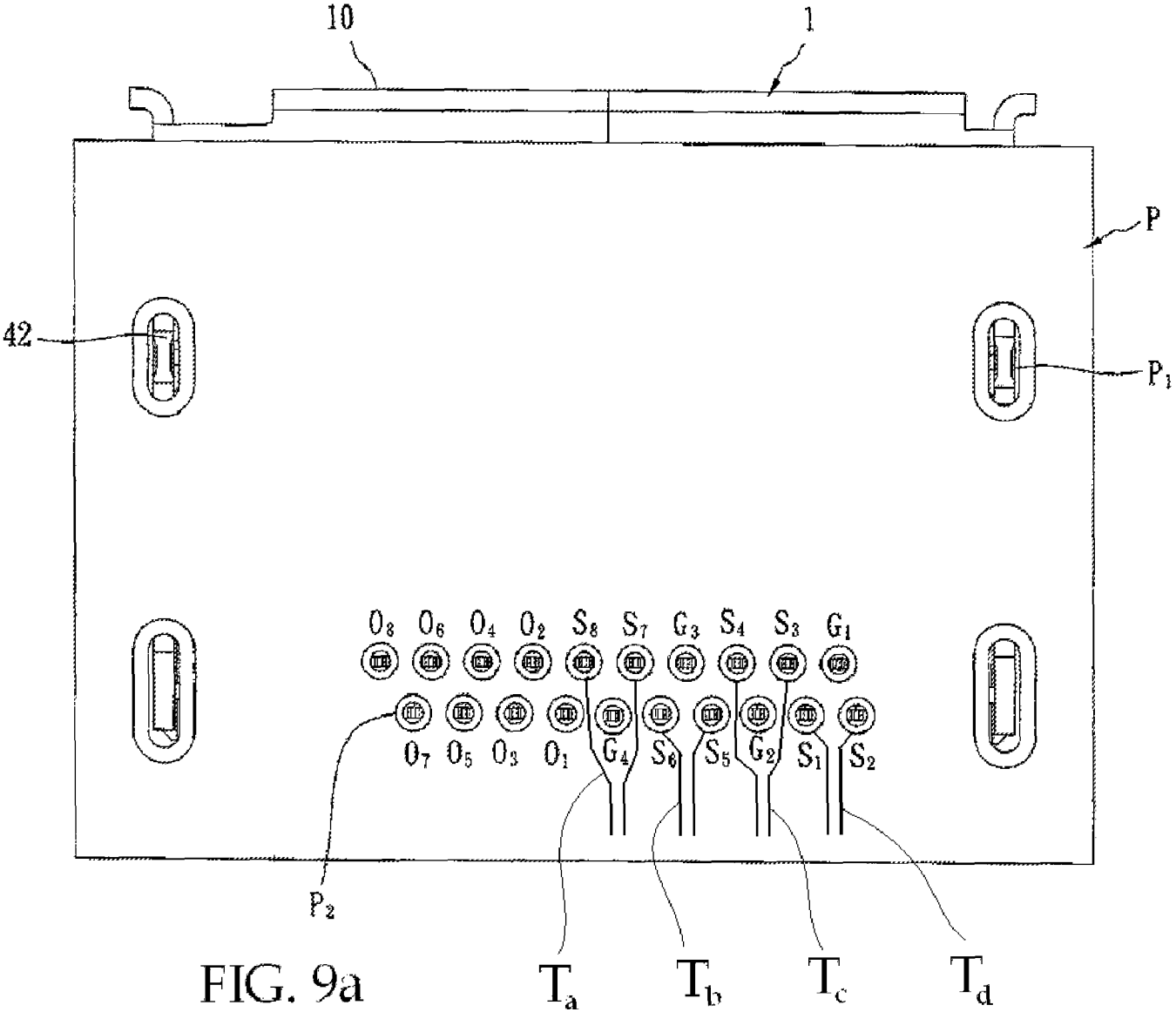
FIG. 9*a* is a bottom plan view of a via arrangement used on a circuit board with connectors, showing schematically, the signal traces exiting from the vias.

In particular, FIG. 9*a* illustrates a schematic of an embodiment of a circuit board P with two lines of terminals evenly spaced (and representing the configuration depicted in FIG. 2 except that the non-signal/ground terminals are positioned on the side instead in the third row). As can be appreciated, extending from the vias are trace sets Ta, Tb, Tc and Td. One thing that was determined to be a problem with such a configuration is the cross-talk that results because of the proximity of trace sets Ta and Tc to vias for other signal pairs. In addition, because of the limited space between the vias, the necessary manufacturing tolerances required to allow the traces to pass between the two terminals caused additional expense to be added to the circuit board P. However, because of the desire to maintain the triangular arrangement of the terminals throughout the connector, from the mating side through and to the mounting side, such a configuration was previously not considered to be desirable to change.

Figure 7:
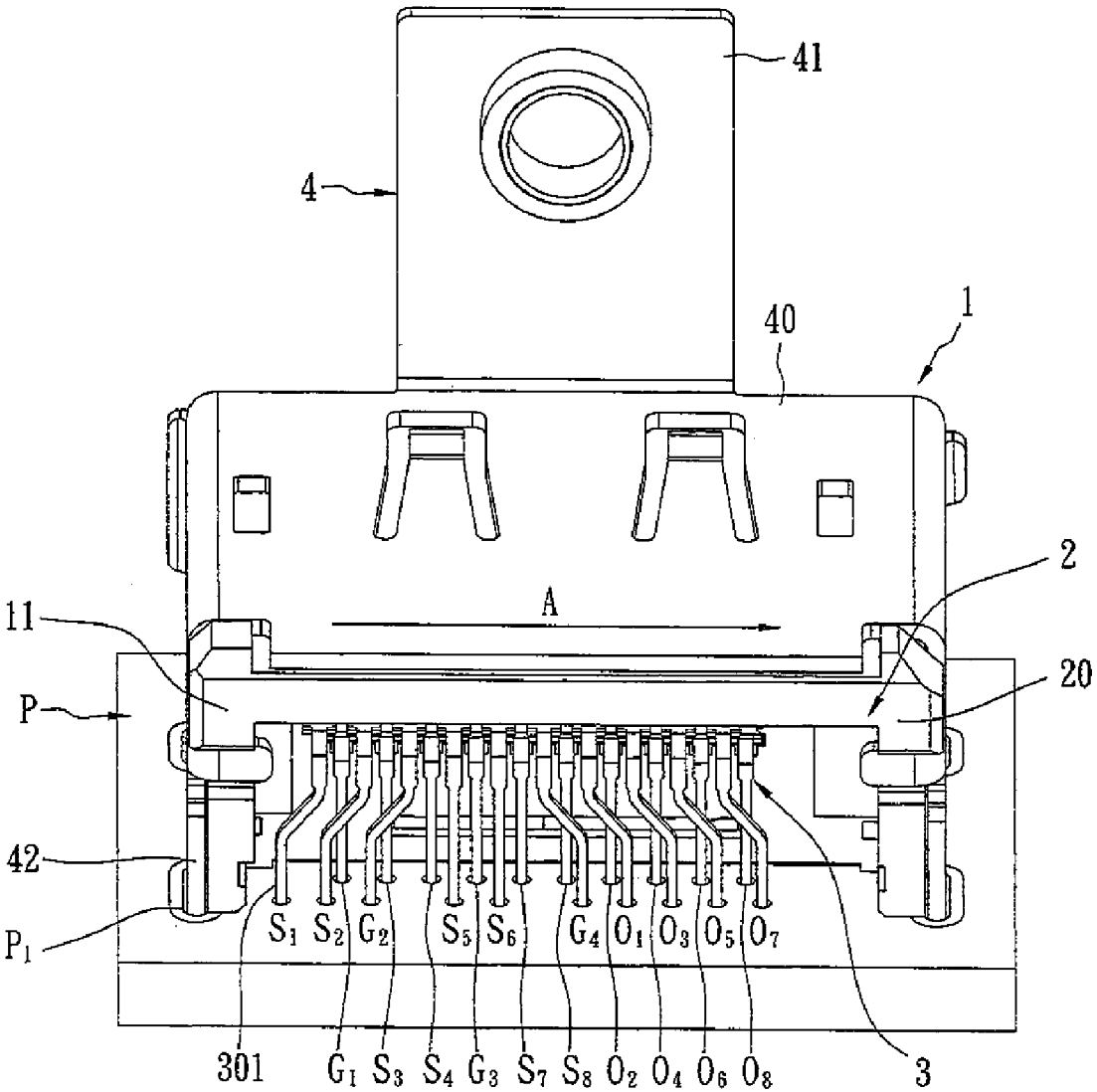
FIG. 7 is a rear elevated view, of the connector of FIG. 3.
Figure 8:
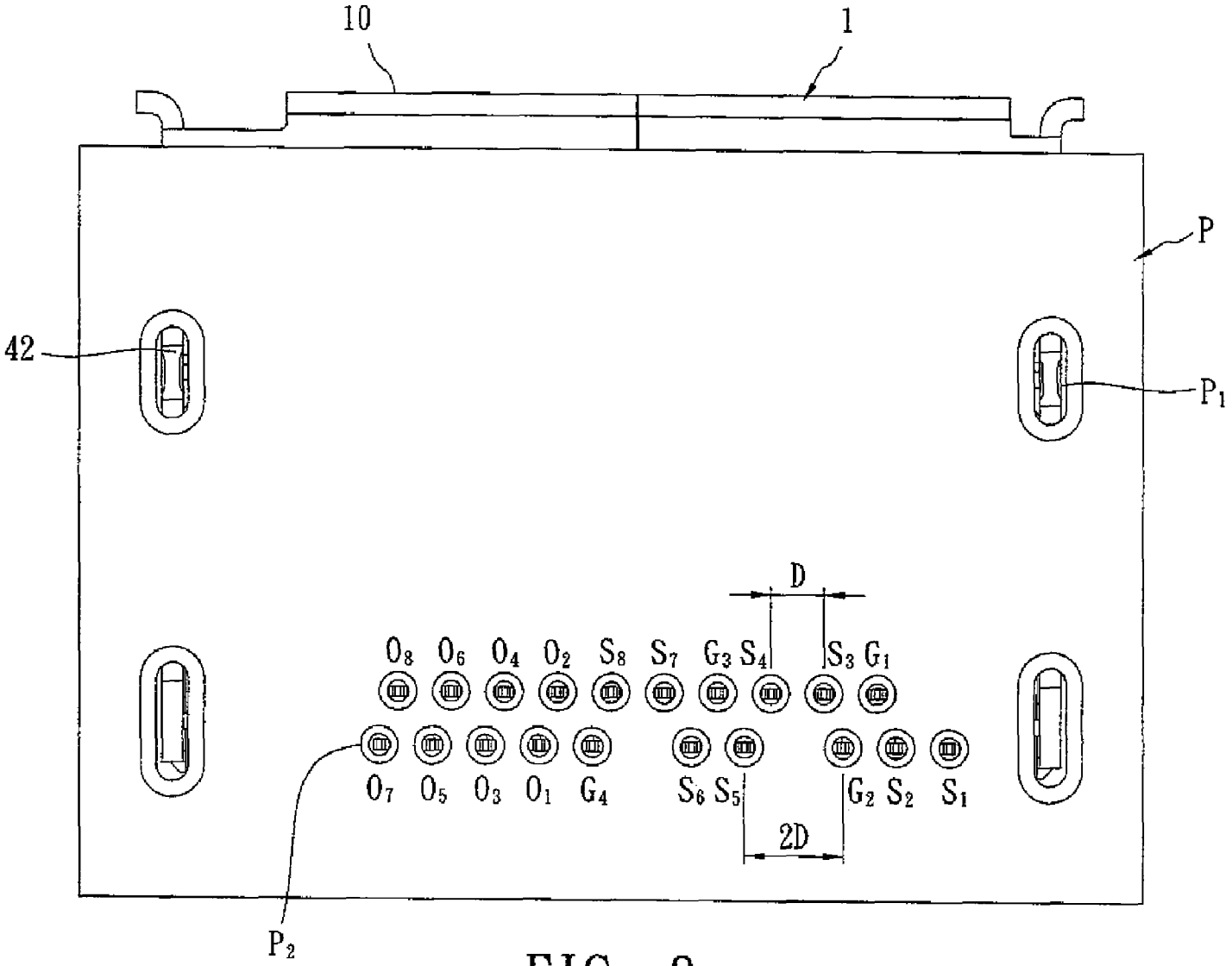
FIG. 8 is a bottom plan view of the underside of the circuit board depicted in FIG. 5.
Figure 9B:
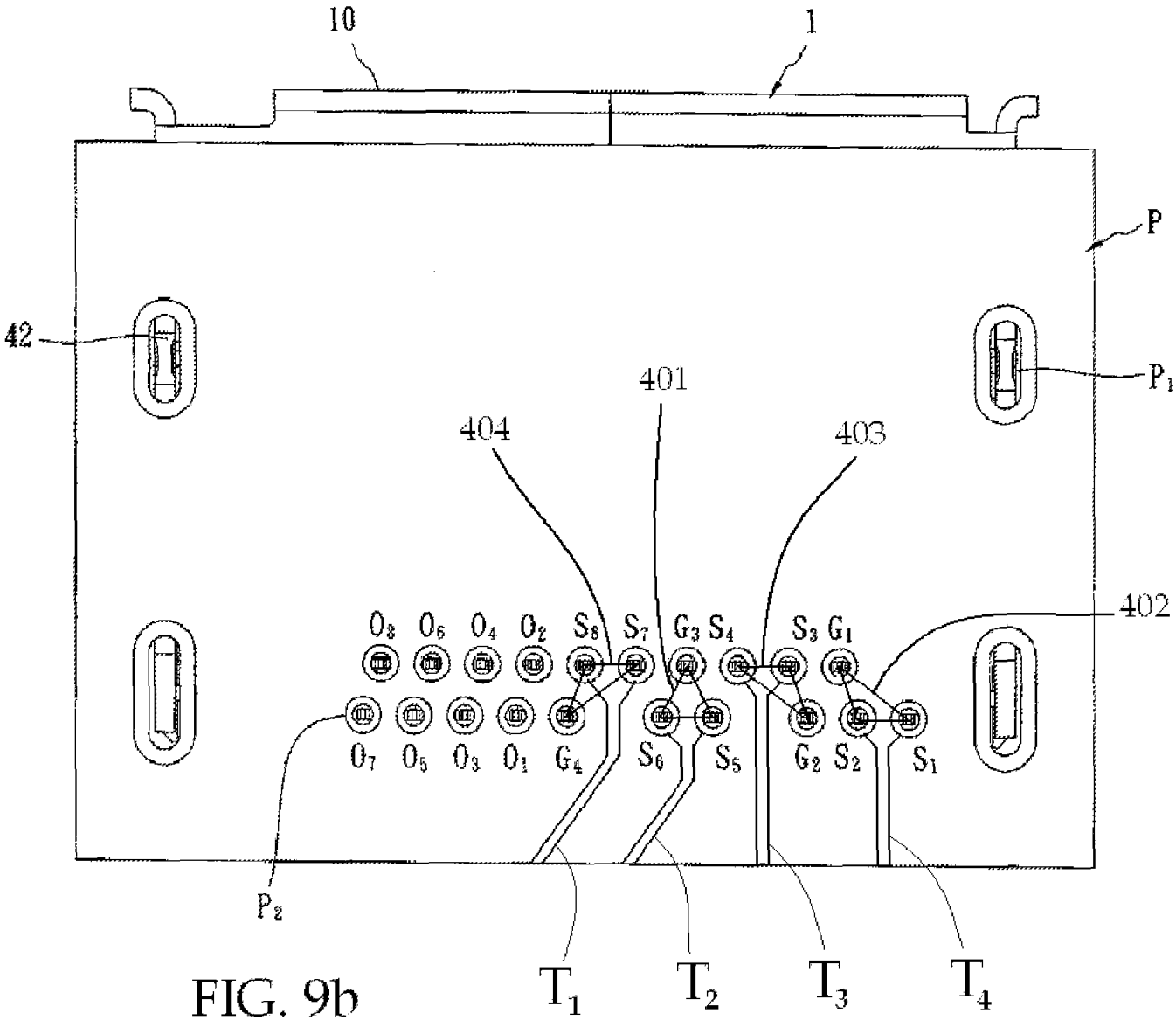
FIG. 9*b* is a bottom plan view of an alternative embodiment of a circuit board with signal traces shown schematically exiting from the vias thereof.

In contrast, as the schematic of the via pattern of the embodiment depicted in FIG. 9*b* illustrates, in an embodiment such as illustrated in FIG. 8 four trace sets T1, T2, T3 and T4 may be provided. As can be appreciated, trace set T1 can now pass through the expanded gap that exists between via G4 and via S6. Similarly, trace set T3 can pass through the expanded gap that exists between via G2 and via S5. Thus, with the via pattern illustrated in FIG. 9*b*, cross-talk on the circuit board may be reduced, manufacturing costs can be lowered and better coupling between the signal traces that form the trace sets Ta and Tc can be realized. Consequentially, the improvements that are possible in the circuit board when the connector is configured as illustrated in FIG. 7 are sufficient to allow the entire system performance to increase versus the cost of implementing the improvements.

While a preferred embodiment of the present invention is shown and described, it is envisioned that those skilled in the art may devise various modifications of the present invention without departing from the spirit and scope of the appended claims.

The invention claimed is:

1. An electrical connector comprising:

an insulative body; and a plurality of conductive signal terminals and a plurality of ground terminals supported by the insulative body, each signal terminal and each ground terminal including a contact portion, a tail portion, and a connection portion interconnecting the contact and tail portions together, the signal and ground terminal contact portions being arranged in first and second rows on said insulative body, said signal terminals and ground terminals which form said first row being equidistantly spaced apart from each other in said first row, said signal terminals and ground terminals which form said second row being equidistantly spaced apart from each other in said second row, wherein said signal and ground terminal tail portions are arranged in first and second rows, and said signal terminals and ground terminals which form said tail portion first row are equidistantly spaced apart from each other in said first row, and some of said second row signal and ground terminal tail portions are equidistantly spaced apart from each other and others of said signal and ground terminal tail portions which form said second row of tail portions are not equidistantly spaced apart from each other.

2. The electrical connector of claim 1, wherein the distance at which said signal and ground terminal contact portions which form said first row are spaced apart from each other and the distance at which said signal and ground terminal contact portions which form said second row are spaced apart from each other are the same distance.

3. The electrical connector of claim 2, wherein the distance at which said signal and ground terminal contact portions which form said first row are spaced apart from each other is the same as the distance at which said signal and ground terminal contact portions which form said first row are spaced apart from each other.

4. The electrical connector of claim 3, wherein the distance at which the equidistantly spaced free ends of said signal and ground terminal contact portions which form said terminal tail portions second row is the same as the distance at which said signal and ground terminal contact portions which form said second row are spaced apart from each other.

5. The electrical connector of claim 4, wherein the distance at which the not equidistantly spaced apart free ends of said signal and ground terminal tail portions which form the second row of foot portions is twice the distance of the equidistantly spaced terminals.

6. The electrical connector of claim 1, wherein the arrangement of said signal and ground terminal contact portions complies with a High Definition Multimedia Interface standard.

7. The electrical connector of claim 3, wherein the distance at which the not equidistantly spaced apart free ends of said signal and ground terminal tail portions which form said tail portion second row is twice the distance of the equidistantly spaced apart signal and ground terminal tail portions which form said tail portion second row.

8. The electrical connector of claim 7, wherein each of said terminal connection portions extend both horizontally and vertically from said terminal contact portion.

9. The electrical connector of claim 8, wherein tail portions of selected ones of said terminals in said second row extend vertically from their connection portions, and said tail portions of the other terminals in said second row are bent diagonally and extend vertically.

10. The electrical connector of claim 1, wherein said insulative body further includes a retaining plate having a plurality of retaining holes formed therein, and said terminal tail portions are inserted into corresponding retaining holes therein.

11. The electrical connector of claim 10, wherein said insulative body further includes engagement grooves, and engagement bumps are provided on the retaining plate for engaging with the engagement grooves.

12. An electrical connector, comprising (geometrical configuration claim):

a housing; and a plurality of conductive terminals disposed in the housing, each of the terminals including a contact portion and a tail portion, the contact and tail portions being disposed at opposite ends of said terminals, wherein the terminal contact portions are arranged in a first set of two, spaced-apart rows and the terminal tail portions are arranged in a second set of two, spaced-apart rows, some of said terminals are configured in at least first, second and third distinct terminal groups, each of the first, second and third terminal groups including first and second signal terminals and a ground terminal associated therewith, said first, second and third terminal groups being arranged in respective first and second arrangements, the first arrangement being disposed along said terminal contact portions and the second arrangement being disposed along said terminal tail portions, wherein in said first arrangement, said terminal contact portions of said first, second and third terminal groups each define an imaginary isosceles triangle, said ground terminal contact portions of adjacent ones of said first, second and third terminal groups being positioned on alternating rows of said first set of rows, and wherein in said second arrangement, said tail portions of said first terminal group defines an imaginary acute triangle and said tail portions of said second and third terminal groups each define an imaginary obtuse triangle and the second and third terminal group are disposed on opposite sides of said first terminal group.

13. The electrical connector of claim 12, wherein said first and second terminal group tail portions are configured so that said first and second terminal group ground terminal tail portions are positioned in different rows of said second set of rows, wherein said ground terminal tail of the second terminal group is positioned adjacent two signal terminal tail of the first terminal group, wherein a distance D1 between the ground terminal foot of the second terminal group and the closest signal terminal foot of the first terminal group is greater than a distance D2 between the two signal terminal feet of the first terminal group.

14. The electrical connector of claim 13, wherein the distance D1 is about two times the distance D2.

15. The electrical connector of claim 13, further comprising a metal cover, the metal cover have four feet configured to extend into a circuit board.

16. The electrical connector of claim 15, further comprising a fourth terminal group, the fourth terminal group having terminal contact portions that define an imaginary isosceles triangle and including terminal tail portions that define an imaginary obtuse triangle.

17. The electrical connector of claim 16, wherein the second and third terminal group each have an obtuse triangular arrangement that is symmetric about the first terminal group.

18. An electrical connector, comprising:

a housing; and a plurality of terminals positioned in the housing, the plurality of terminals each including a contact portion and a foot portion and positioned in the housing so that the contact portions of the plurality of terminals are in a first row and a second row and the foot portions of the plurality of terminal are in a third row and a fourth row, wherein the distance between each of the adjacent contact portions in the first row and the second row is substantially the same, wherein the space between each of the foot portions in the third row is a distance D, and wherein the fourth row includes a first foot portion, a second foot portion, a third foot portion and a fourth foot portion in a line, wherein a space between a second and third foot portion is the distance D and the space between the first foot portion and the second foot portion is a distance D2 and a space between the third and fourth foot portion is a distance D2, wherein D2 is greater than D.

19. The electrical connector of claim 18, wherein the distance D2 is about twice D.

20. The electrical connector of claim 18, wherein the second and third foot are configured to be a differential signal pair and the first and fourth foot are configured to be ground terminals.

21. The electrical connector of claim 20, wherein the first foot is part of a first terminal group, the second and third foot are part of a second terminal group and the fourth foot is part of a third terminal group, each of the first, second and third terminal group including one differential signal pair.

22. An electrical connector, comprising:

an insulative connector housing, and a plurality of conductive terminals disposed in the connector housing, each of the terminals including a contact portion and a tail portion disposed at opposite ends of said terminals, said terminals being arranged in at least first, second and third distinct terminal groups, each of the first, second and third terminal groups including first and second differential signal terminals and a ground terminal associated therewith and each of said first, second and third terminal groups defining a single differential signal transmission line extending through said connector housing;

said connector housing including a mating face and a mounting face, said terminal contact portions being arranged in a first terminal array along the connector housing mating face and said terminal tail portions being arranged in a second terminal array along the connector housing mounting face, wherein in said terminal first array, said terminal contact portions are symmetrically arranged in first and second rows, and in said terminal second array, said terminal tail portions are asymmetrically arranged in a third and fourth rows;

said terminal contact portions of said first, second and third terminal groups being further arranged at apexes of imaginary acute triangles and said terminal tail portions of said first, second and third terminal groups being further arranged at apexes of imaginary triangles, said tail portions of said first terminal group defining an imaginary acute triangle and said tail portions of said second and third terminal groups define two imaginary obtuse triangles which are disposed on opposite sides of said first terminal group acute triangle.

23. The connector of claim 22, wherein, in each of said first and second rows, said terminal contact portions are spaced apart from each other a first distance, and in said third row, said terminal tail portions are spaced apart from each other said first distance, and in said fourth row, said terminal tail portions of said second and third terminal groups are spaced apart from said terminal tail portions of said first terminal group a second distance greater than said first distance.

24. The connector of claim 23, wherein said second distance is equal to approximately twice the first distance.

25. The connector of claim 22, wherein said fourth row includes said two signal terminal tail portions of said first terminal group and said ground terminal tail portions of said second and third terminal groups, said second and third terminal group ground terminal tail portions being respectively disposed on opposite sides of said first terminal group signal terminal tail portions.

26. The connector of claim 25, wherein said first terminal group signal terminal tail portions are spaced apart from each other said first distance D and said second and third terminal group ground terminal tail portions are spaced apart from said first terminal group signal terminal tail portions said second distance.

27. The connector of claim 26, wherein second and third terminal group signal terminal tail portions are disposed in said third row so they respectively oppose said second distance spacing of said fourth row.

* * * * *